US006688065B2

(12) United States Patent
Chambers

(10) Patent No.: US 6,688,065 B2
(45) Date of Patent: Feb. 10, 2004

(54) FLOORING CONSTRUCTION

(76) Inventor: Robert X. Chambers, 1623 Margo La., West Chester, PA (US) 19380

( * ) Notice: Subject to any disclaimer, the term of this patent is extended or adjusted under 35 U.S.C. 154(b) by 43 days.

(21) Appl. No.: 10/098,483

(22) Filed: Mar. 14, 2002

(65) Prior Publication Data

US 2003/0172608 A1 Sep. 18, 2003

(51) Int. Cl.[7] ..... E04F 15/22
(52) U.S. Cl. ..... 52/480; 52/403.1; 52/489.1
(58) Field of Search ..... 52/403.1, 480, 52/489.1, 489.2; 472/92

(56) References Cited

U.S. PATENT DOCUMENTS

| | | | | | |
|---|---|---|---|---|---|
| 2,317,015 | A | | 4/1943 | Allen | |
| 2,317,428 | A | | 4/1943 | Anderson | |
| 2,368,620 | A | | 2/1945 | Strom | |
| 2,539,038 | A | | 1/1951 | Shumaker | |
| 3,271,916 | A | | 9/1966 | Omholt | |
| 3,577,694 | A | | 5/1971 | Omholt | |
| 3,713,264 | A | | 1/1973 | Morgan | |
| 4,599,842 | A | | 7/1986 | Counihan | |
| 4,856,250 | A | | 8/1989 | Gronau | |
| 5,016,413 | A | * | 5/1991 | Counihan | 52/403.1 X |
| 5,497,590 | A | * | 3/1996 | Counihan | 52/403.1 X |
| 5,526,621 | A | | 6/1996 | Shelton | |
| 5,647,183 | A | * | 7/1997 | Counihan | 52/403.1 |
| 5,906,082 | A | * | 5/1999 | Counihan | 52/403.1 |
| 6,073,409 | A | * | 6/2000 | Chambers | 52/403.1 |
| 6,122,873 | A | * | 9/2000 | Randjelovic | 52/403.1 |
| 6,158,185 | A | * | 12/2000 | Counihan | 52/403.1 |

* cited by examiner

*Primary Examiner*—Robert Canfield
(74) *Attorney, Agent, or Firm*—Anthony J. McNulty, Esq.

(57) ABSTRACT

An athletic floor assembled on a foundation having a capacity to absorb vibration, eliminate dead spots, and remain stable and resistant to the damaging effects of moisture which comprises discrete sections of reproducible subflooring constructions which are separated from each other so there are gaps between every section which prevents the ripple effect transmission of vibration forces which combines a wood nailing bed underlayment engaged inside the open face of a c-channel support system in which such engaged components are held in fixed elevation over the foundation and supported on strips of resilient material, and further comprising anchoring clips having a vertical riser member and engagement tabs at a top and which are engaged to the channels inside deflexure slot aperture cut in the channels and engaged to the foundation by fastening tab means at the bottom end and adapted to permit the entire floor construction to experience slidable vertical deflexure movement as limited by the limits of the deflexure riser element.

14 Claims, 3 Drawing Sheets

FLOORING CONSTRUCTION

BACKGROUND OF THE INVENTION

1. History of the Technology

Two of the many practical problems confronting installers of large athletic flooring constructions are dampening vibration and avoiding damage to the floor resulting from the ineluctable deterioration caused by moisture. Since the installation cost of such floors is expensive, there has been a longfelt need to solve such problems. Most sports floors are poor vibration and shock absorbers; they become unstable when exposed to water because the wood members of the subfloor components expand and contract and tend to warp and ultimately become loosened and this causes the whole floor construction to develop dead spots and become unstable and vibrate and the exterior floor surface no longer provides a reliable playing surface having the desired consistent uniform ball-bounce response. The prior art has long been in search of a flooring construction that is assembled quickly, that reduces vibration, absorbs shock, is moisture resistant and provides a faster, stable playing surface without vibrations and dead spots on which a round ball has a livelier more consistent bounce.

2. Discussion of the Prior Art

A shock absorbent athletic flooring system without vibrations has been the elusive object of many patent inventions. Unfortunately, a lot of athletic floors are too loose and have floating members and dead spots, or they are fastened so tight that there is little or no shock absorbing capacity. The prior art floors are difficult to install and all suffer from having guide channels which support the subfloor nailing beds which channels are rendered immobile because they are fastened directly to a concrete foundation; see the Counihan, Grenau and Amholt patents. Regardless of the insertion of a myriad of springs, foam pads, and such like into the subfloor, the channel guideways in the prior art are pinned down directly to the foundation so the floor can not breathe and rise above the foundation. Representative prior art disclosures include the following U.S. Patents: Allen U.S. Pat. No. 2,317,015; Anderson U.S. Pat. No. 2,317,428; Strom U.S. Pat. No. 2,368,620; Shumaker U.S. Pat. No. 2,539,038; Omholt U.S. Pat. No. 3,271,916; Omholt U.S. Pat. No. 3,577,694; Morgan U.S. Pat. No. 3,713,264; Counihan U.S. Pat. No. 4,599,842; Grenau U.S. Pat. No. 4,856,250; Counihan U.S. Pat. No. 5,016,413; Shelton U.S. Pat. No. 5,526,621; and Counihan U.S. Pat. No. 5,647,183. The prior art floors are expensive to install because of the expense of labor and materials.

SUMMARY OF THE INVENTION

This invention concerns a flooring construction which can move up and down within defined deflexure limits. The floor has a novel subfloor assembly which is elevated above its foundation base. The subfloor sections are separated by a gap from each other; they do not touch each other. This reduces vibration in the total floor construction. This invention is a resilient subflooring construction for assembly of a top floor on a foundation which comprises a plurality of spaced apart parallel layers of underlayment members extending longitudinally along the foundation, each having an outside edge and an inside edge. The underlayment members are illustrated by reference signs 12 and 13 in FIGS. 2 and 4. A plurality of spaced apart parallel channel means support the underlayment members and they also extend longitudinally along the foundation, each channel has a closed horizontal top and bottom side in parallel with the plane of said foundation, and they have two vertical sides comprising an opening into the channel at one side and a closed vertical side between said horizontal top and bottom sides and each vertical side is perpendicular to the plane of the foundation. The inside edge of the underlayment member is in engagement with the channel extending through its opening at one end to be supported inside the channel. The channels are elevated above the foundation surface by a plurality of anchoring clip means for engaging the channel to the foundation. Each clip is comprised of three members including a horizontal tab engagement member at its top for engagement inside the channel, a vertical riser member at its middle to permit downward and upper movement of the construction, and a horizontal tab fastening member at its bottom, facing in an opposite direction from the top tab member, for fastening to the foundation. The anchoring clip is illustrated by reference sign 6 in FIGS. 2 and 4. The closed vertical side of the channel has a vertical deflexure slot aperture for engagement with the horizontal tab member of the anchoring clip with each vertical deflexure slot positioned for such engagement which permits deflexure movement of the construction downwards and limits the extent of its upward movement by the height of the vertical riser member of the anchoring clip. The top floor surface is fastened by fastening means such as nails to underlayment members, and the horizontal fastening tab at the bottom of said anchoring clip is fastened by fastening means, such as a pin, to said foundation. The subfloor section comprises c-channel support means having deflexure slots or apertures, layers of wood underlayment which serve as a nailing bed, and deflexure anchor clips that slidably engage the channels and foundation with each other, but they only interlock indirectly with the foundation base. The product of this invention is a superior flooring construction which was not possible to assemble using the prior art components and methods of fabrication. The underlayment is a nailing bed consisting of two layers of wood panels, arranged in parallel to the upper hardwood strips surface which underlayment is adapted for engagement in an open face of c-channel support means which have deflexure slot cut-outs to form apertures which are engaged by the anchor clips. The anchor clip comprises three members including a top member which is a tab that is inserted into deflexure slots in the channel which are apertures cut in the bottom faces of the c-channels which are in registered alignment. The open face of the c-channel envelops the inside edge of the bottom layer of the wood underlayment as illustrated in the drawings described in detail herein. This bottom layer of underlayment is superposed on strips of parallel resilient pad materials centered at about eight to twelve inch intervals on the surface of the foundation which causes the underlayment and c-channel support means of the construction to be elevated above the foundation so that the subfloor has no direct contact with the foundation surface and is slidably and indirectly anchored thereto by means of the bottom tab member of the anchor clip fastening means which permits the entire floor construction to move slidably up and down along the juncture of the aperture cut in the channel and the vertical riser deflexure member 10 which is the middle vertical member of the anchor clip 6 as illustrated in the drawings; this capacity for such reciprocal motion enables the floor to respond to external forces acting upon the hardwood floor board surface of the flooring construction. In this novel construction all of the open faces of the c-channels support means are aligned with their open faces pointed in the same horizontal direction which is in the direction back to the starter-wall of the construction. No c-channel has an open face pointing in an opposite direction to another c-channel. As illustrated in FIG. 4 of the drawings, the wood underlayment is supported in the open face of the c-channel. This floor construction is tighter than the prior art floors so it provides more resistance to a bounced ball and the result is a livelier floor, yet, at the same time its capacity for deflexure movement absorbs shock and vibration.

The best analogy for an understanding of the vibrating dampening effect which is a characteristic of this inventive floor is the example of throwing a pebble into a pond and creating contiguous concentric circles which evolve from the center of the pond to the outside edge of the pond. Since the subfloor sectional component of the floor of this invention are separated from each other, and are not contiguous, vibrations are not transmitted throughout the flooring construction.

As discussed in detail hereinbelow, when a second subfloor assembly is positioned next to a first subfloor assembly about a one-quarter inch gap is left between the edges of the plywood underlayments where the component subfloor sections do not butt up against each other on the foundation. The purpose of setting this one quarter inch gap between adjacent subfloor assembly sections is to dampen vibrations and permit the expansion and contraction of the wood to take place without the consequence of butting wood against wood and causing squeaking, or rubbing of wood against a steel C-Channel and causing squeaking. Without leaving the intentional gap between subfloor sections, the floor would experience stress over a period of time and could go crooked and buckle-up if the sections butted up against each other. The top layer of plywood is cut in a groove cut-out longitudinally along the length of the C-Channel so that the top surface of the C Channel is exposed. The reason that this groove is cut is to avoid unevenness of the subfloor if the top layer of the plywood were placed directly onto the top surface of the C-Channel.

Also keeping the C-Channels elevated above the concrete foundation base overcomes the problem of water condensing over the substantial square foot area of the concrete base which would inherently contain uneven surfaces and low spots of water wells or pools; this invention eliminates this problem by elevating the entire subfloor assembly above the concrete foundation base and leaving gaps between sections of subflooring.

The above described subflooring constructions may be preassembled in sections, e.g. eight feet by fifteen inches, at a factory site, and attached on site of the floor to the base foundation. The preferred floor comprises gaps of about one quarter inch between each preassembled subsection which gaps can be covered-over by nailing the top hardwood floor boards, e.g. maple wood, to the underlayment wood nailing bed in side-by-side relationship superposed and transversely spanning the c-channels which may be centered, e.g. at fifteen inch intervals. The layers of wood underlayment may be nailed or glued to each other; the preferred underlayment is three ply or four ply plywood. This novel elevated channel-underlayment-anchor-deflexure clip system exhibits more holding power in the presence of moisture and reduces vibration. An especially useful feature of the floor product of this invention is the speed and ease of assembly and installation of the subfloor sections.

Another feature of this invention is that it reduces the number of c-channel support means which form the subfloor sections. This reduction in the number of construction parts inherently reduces the amount of labor and time and material required to assemble the flooring construction. The anchor deflexure clip fastening means are spaced apart at about twenty four (24") inch intervals along the deflexure slot side of the c-channel. The hardwood maple outer floorboards are nailed directly into the plywood underlayment over top of the gaps between subfloor sections, and this tight-joined connection compensates for securing only one inside edge of the plywood underlayment inside the open face of the c-channel instead of engaging both the outside and inside edges of the plywood panel to the c-channel. The deflexure slots or apertures in the c-channel and the anchor clip deflexure fasteners of this invention may be cut as illustrated in FIG. 4, numeral 7 herein which shows an aperture in the form of a T-slot, and they may be constructed from the materials and methods illustrated and explained in detail in my earlier Chambers U.S. Pat. No. 6,073,409, e.g. FIGS. 4–7 for more details.

The underlayment means of this invention is a nailing bed which comprises a subfloor component of two layers of plywood having a top layer and a bottom layer which latter is firmly secured in horizontal fixed retaining engagement within the open face of a plurality of elongated spaced parallel c-channel support and guide means having deflexure slots or apertures which are slidably engaged by the vertical riser elements of a plurality of deflexure tab fastening means (described in my U.S. Pat. No. 6,073,409) which indirectly and slidably anchor the c-channel means to the surface of a base foundation, such as concrete, yet permit the channel means and plywood layers to slide up and down the distance of the height of the vertical riser member of the deflexure tab fastening means. The surface of the c-channel which faces the bottom of this inventive flooring construction, and the bottom surface of the lower layer of plywood are both elevated over the base foundation substance, such as concrete; the reason why they are elevated is because the plywood components are superposed on top of a plurality of elongated spaced apart strips of flexible resilient material, such as rubber pads or foamed closed cell polyethylene or polyurethane foam material, and the resilient strips are placed directly on top of the surface of the foundation base. If desired a film of polyethylene moisture barrier material may be interposed between the strips of flexible resilient material and the foundation base surface to reduce the damaging effects of moisture and water vapor on the wood members of the construction. The foregoing construction provides a stable athletic floor that is reproducible and relatively free of vibration. The floor is capable of rising and lowering, but the distance traveled is governed and restricted by the height dimensions of the resilient pads placed under the bottom surface of the wood underlayment, the deflexure slots cut in the c-channel, and the vertical middle deflexure riser member 10 of the anchor clips. The floor construction slides up and down along the boundaries of the vertical riser member of the anchoring deflexure clip which is engaged in the deflexure slot aperture cut in the perpendicular panel of the c-channel.

BRIEF DESCRIPTION OF THE DRAWINGS

Following is a description of the plan for the cooperating elements of the athletic flooring construction which is devised to carry out the purposes of this invention. A study of these drawings will provide an understanding of this invention.

DETAILED DESCRIPTION OF THE DRAWING

Figure 1:
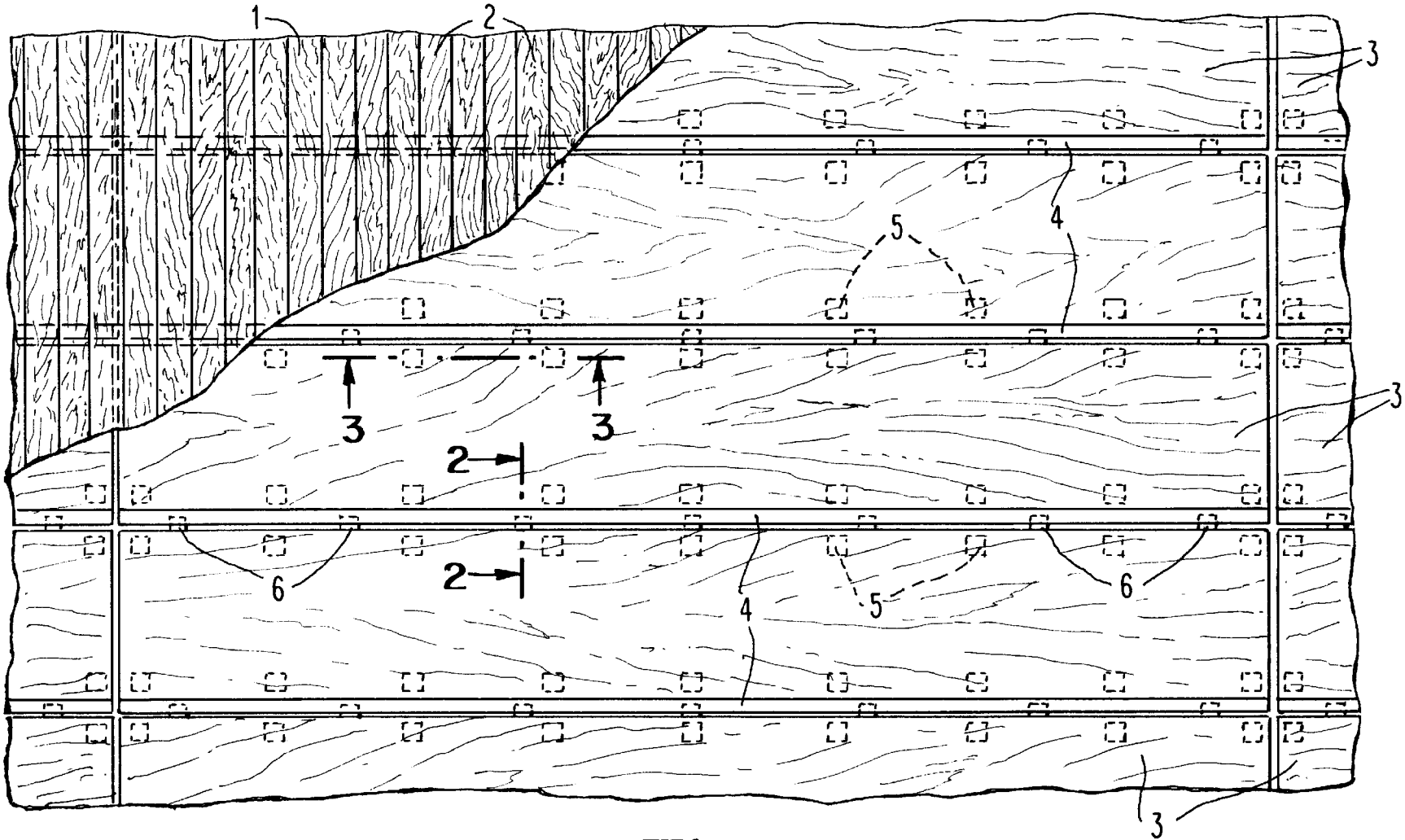
FIG. 1 is a sectional plane view from the top of the sports flooring construction looking down through a subfloor assembly section.
Figure 4:
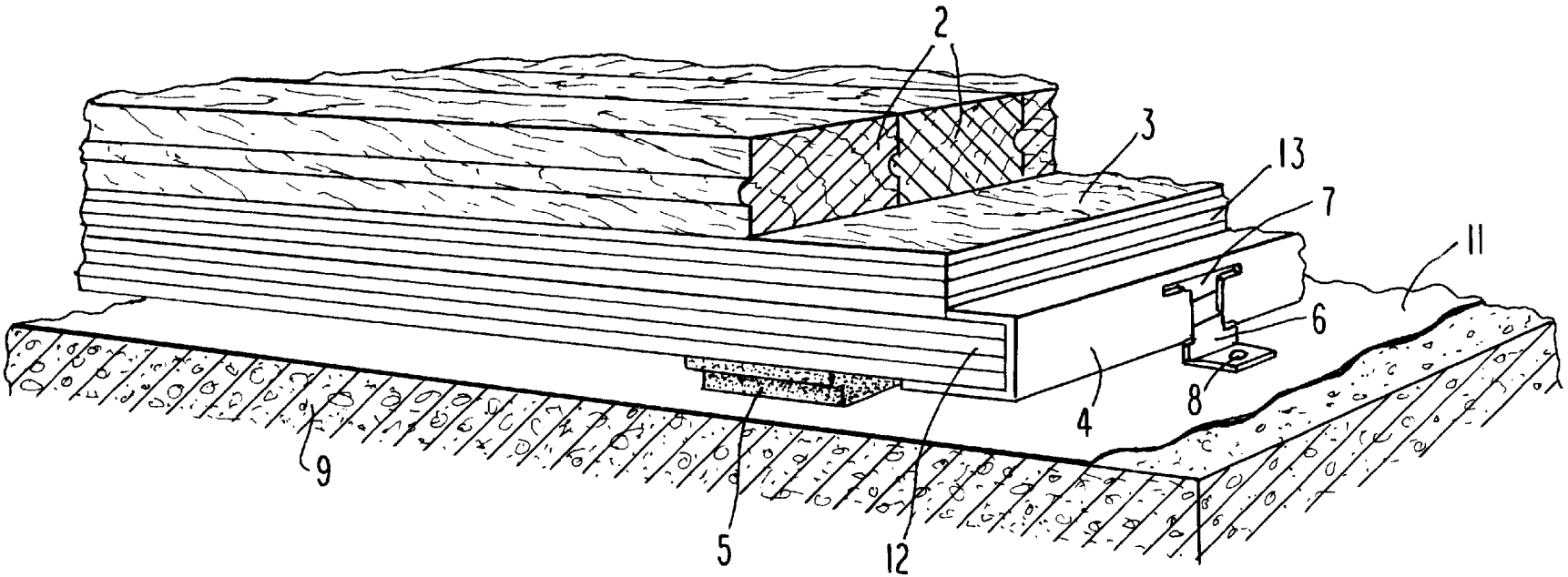
FIG. 4 is a perspective view of the flooring construction.

FIG. 1 reveals an entire athletic floor construction 1 which comprises strips of hardwood floor boards 2 supported by a subfloor assembly which comprises a plurality of panels of wood nailing bed underlayment 3 which are firstly supported at their bottom surfaces on a plurality of parallel strips of resilient vibration absorption pads 5 and secondly supported at their inside edges where they are engaged in the open face slots of a plurality of parallel c-channels 4 which are indirectly anchored to the foundation 9 by means of deflexure clips or clamps 6 which are engaged by their horizontal tab member at the top of the clip inside the deflexure slots 7 cut in the bottom of the c-channel 4 which slots are illustrated as T-shaped slots in FIG. 4. The floor slides downward and upward along the middle vertical riser 10 of deflexure clip 6 in FIG. 2. The c-channel may be formed with 22 gauge zinc plated steel; the deflexure slots 7 may be cut twenty four (24") inches on center. The hardwood floor boards 2 may be maple in the dimension of 25/32 inch×2¼ inch at random lengths. The panels of wood underlayment 3 may be in the dimension of eight feet by fifteen inches by one-half inch. The deflexure anchor clip 6 or clamps may be formed with 16 gauge zinc plated steel. The resilient rubber pads 5 may be formed with lipped natural rubber pads and in the dimensions of two and one-quarter inch by one and one-half inch by three eighths of an inch; alternately, closed cell polyethylene foam can be used in the dimensions of eleven inches wide by one-half inch thick 1.7 pound per cubic foot density, or four and one-half inch wide by one-quarter inch thick 1.2 pound per cubic foot density.

Figure 2:
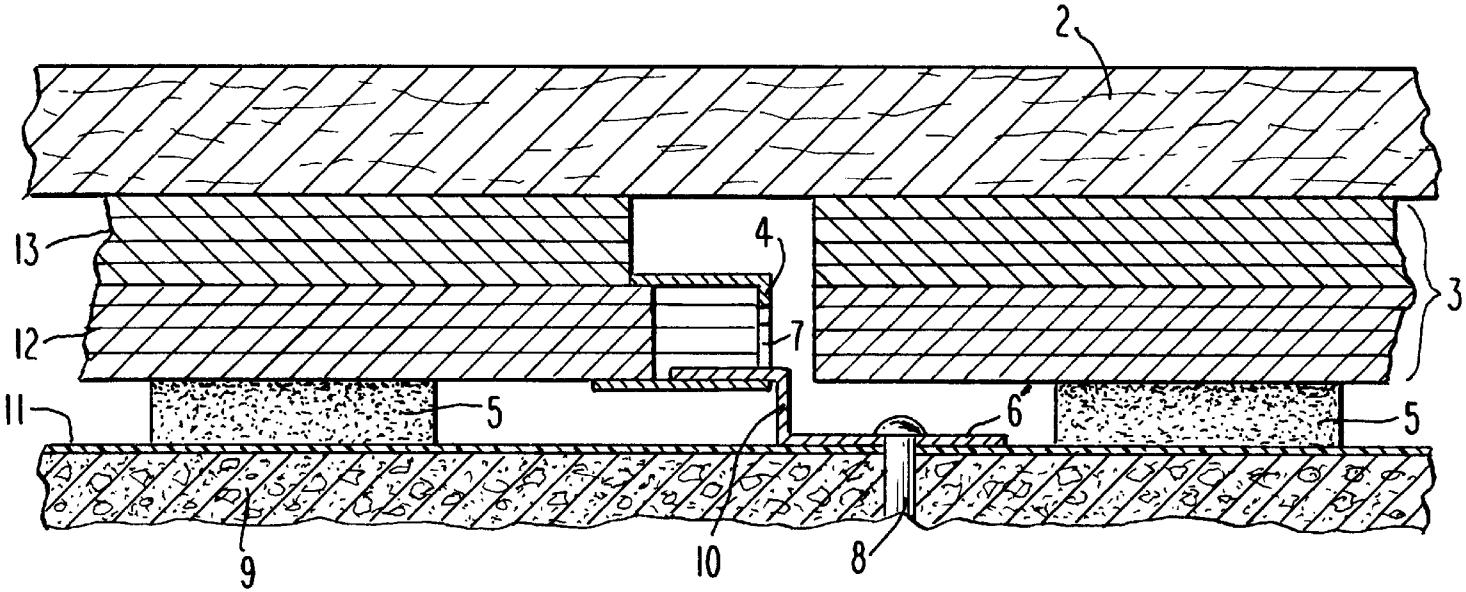
FIG. 2 is an enlarged elevational cross section view along line 2—2 of FIG. 1.

FIG. 2 which is an elevational cross section view along line 2—2 of FIG. 1 reveals a concrete foundation 9 which provides a stable, level support means for the floor construction; a vapor barrier film 11 of a suitable material resistant to moisture and water, such a film of polyethylene material; an anchor pin 8 which fastens the bottom tab member 6 which extends in a first horizontal direction from of the three member deflexure fastening clip 6 or clamps to the foundation 9; the top horizontal tab member which extends from the top of deflexure riser member 10 opposite in direction from said bottom member of the fastening clip is engaged inside the c-channel through its deflexure slot 7 as seen in FIG. 2 and FIG. 4; the cross-hatch marked section of FIG. 2 shows the underlayment nailing bed 12; the horizontal hatching shown in FIG. 2 next to the cross-hatching illustrates empty space notched out for inserting the anchoring clip 6 into the deflexure slot 7 of the channel. The c-channel 4 and the top 13 and bottom 12 layer of the two layer plywood nailing bed underlayment 3 are elevated and supported above the concrete foundation 9 by means of resilient pads 5; the bottom layer 12 of wood underlayment 3 is fixedly engaged parallel to the foundation base inside the open face of the c-channel 4; and the maple hardwood floor boards 2 are nailed to the wood underlayment 3 in a parallel pattern perpendicular to the direction of the c-channels.

Figure 3:
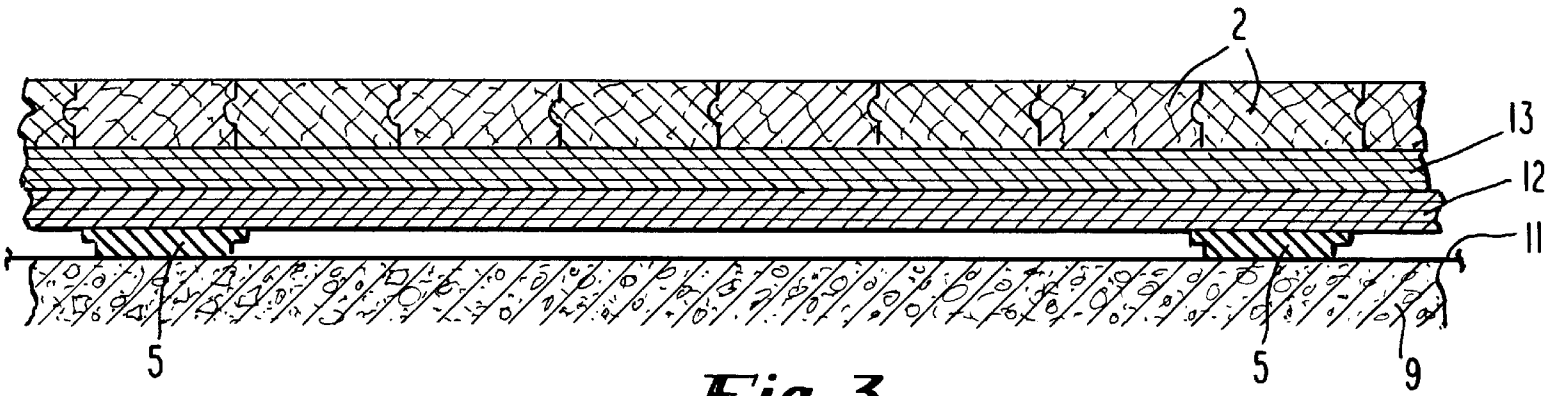
FIG. 3 is an elevational cross section view along line 3—3 of FIG. 1.

FIG. 3 is an elevational view along line 3—3 of FIG. 1; it reveals the concrete foundation 9 separated from direct contact with the subfloor assembly by resilient pads 5 on which rests the bottom layer 12 of the wood underlayment 3 upon which sits its top layer 13 upon which sits the upper surface of parallel strips of maple hardwood floor boards 2 which may be fastened by nailing or stapling through their tongue member directly to the wood underlayment.

FIG. 4 which is a perspective view of the flooring construction illustrates an embodiment of this invention which comprises the elongated parallel removal of that certain portion of the top layer 13 of each member of wood underlayment immediately above the upper facing closed horizontal side of the c-channel 4 in order to form a cut-out groove and expose the corresponding surface of the bottom layer 12 member in order to facilitate the installation of the deflexure clip 6 into the deflexure slot of the c-channel 4 to form the subfloor assembly, and provide an even surface for attachment to the upper hardwood floor boards.

What is claimed is:

1. A resilient subflooring construction for assembly of a top floor on a foundation which comprises a plurality of spaced apart parallel layers of underlayment members extending longitudinally along the foundation, each having an outside edge and an inside edge; a plurality of spaced apart parallel channels for support of the underlayment members extending longitudinally along the foundation, each said channel having a closed horizontal top side and a closed horizontal bottom side in parallel with the plane of said foundation and having a first open vertical side and a second closed vertical side perpendicular with the plane of said foundation, said first vertical side having an opening into said channel and having said second vertical side closed between said horizontal top side and bottom side; and having said inside edges of said underlayment member in engagement with said channel extending through its said opening; a plurality of anchoring clips comprised of three members for engaging said channel to said foundation, each clip having a horizontal tab engagement member at its top for engagement inside the channel, a vertical riser member at its middle, and a horizontal tab fastening member at its bottom, facing in an opposite direction from the top member, for fastening said channel to said foundation; said closed second vertical side of said channel having vertical deflexure slots for engagement with the horizontal tab member of said anchoring clips and having each said deflexure slot positioned for such engagement wherein said construction moves downwards and upward for a distance limited by the height of said vertical riser member of the anchoring clip; wherein said top floor surface is fastened by fastening means to said underlayment members, and said bottom horizontal fastening tab members of said anchoring chips are fastened by fastening means to said foundation.

2. A floor comprising a plurality of said subflooring constructions of claim 1 assembled in spaced apart separation on said foundation.

3. A floor comprising an assembly of the subflooring constructions of claim 2 wherein said top floor surface is fastened by fastening means to an upper surface of said underlayment members.

4. The construction of claim 1 which comprises a plurality of elongated parallel strips of resilient support means between said foundation and said underlayment.

5. The construction of claim 1 wherein said channels and underlayment members are engaged above the surface of said foundation.

6. The floor of claim 3 wherein said fastening means are nails.

7. The floor of claim 3 wherein said fastening means is a glue composition.

8. The construction of claim 1 wherein said openings into said channels for supporting said underlayment members are aligned in the same direction.

9. The construction of claim 1 wherein said top horizontal tab member of said anchoring clips extend outside of said deflexure slot.

10. The construction of claim 1 wherein said anchoring clips and said deflexure slots are positioned spaced apart in longitudinal relationship along the extended length of said channels.

11. The construction of claim 1 wherein a layer of moisture barrier material covers the surface of said foundation.

12. The construction of claim 1 wherein a layer of polyethylene material covers the surface of said foundation.

13. A section of subflooring construction for assembly of a top floor on a foundation which comprises channel means for supporting an underlayment member of said construction having an opening into a side of said channel means engaging an edge of a bottom layer of said underlayment member and having deflexure slot means slidably engaging anchoring clip fastening means for fastening said floor construction in engagement with said foundation.

14. A resilient, stable, shock and vibration absorbent, moisture resistant flooring construction on a foundation which comprises a plurality of subflooring construction sections comprising channels having openings into a side of said channels engaging an edge of a bottom layer of underlayment means and having deflexure slot means slidably engaging anchoring clip fastening means for fastening said flooring construction in engagement with said foundation.

* * * * *